US008631841B1

(12) United States Patent
Levy et al.

(10) Patent No.: US 8,631,841 B1
(45) Date of Patent: Jan. 21, 2014

(54) COLLECTION FUNNEL

(71) Applicant: Navajo Manufacturing Company, Inc., Denver, CO (US)

(72) Inventors: Gordon Levy, Golden, CO (US); Ming Shan, Thornton, CO (US); David L. Martin, Highlands Ranch, CO (US)

(73) Assignee: Navajo Manufacturing Company, Inc., Denver, CO (US)

( * ) Notice: Subject to any disclaimer, the term of this patent is extended or adjusted under 35 U.S.C. 154(b) by 0 days.

(21) Appl. No.: 13/780,541

(22) Filed: Feb. 28, 2013

(51) Int. Cl.
*B65B 39/00* (2006.01)

(52) U.S. Cl.
USPC ..... 141/342; 141/333

(58) Field of Classification Search
USPC ..... 141/199–204, 297–300, 331–345
See application file for complete search history.

(56) References Cited

U.S. PATENT DOCUMENTS

| | | | | |
|---|---|---|---|---|
| 2,179,400 | A * | 11/1939 | Casner | 141/334 |
| 3,899,012 | A | 8/1975 | Sather | |
| 5,092,471 | A | 3/1992 | Pinizzotto et al. | |
| 5,497,814 | A | 3/1996 | Cannon | |
| 6,098,678 | A | 8/2000 | Shears | |
| 6,179,022 | B1 | 1/2001 | Schneider et al. | |
| 6,450,219 | B1 | 9/2002 | Ingram | |
| D555,439 | S | 11/2007 | Fletcher et al. | |
| 2012/0152408 | A1 | 6/2012 | Levy et al. | |

* cited by examiner

*Primary Examiner* — Jason K Niesz
(74) *Attorney, Agent, or Firm* — Studebaker & Brackett PC

(57) ABSTRACT

A funnel having a collection area disposed at one end of the funnel. A base surface of the collection area is flat. A flange surrounding an inlet opening is positioned spaced from the collection area. When the funnel is placed in a vertical orientation with the base surface of the collection area contacting a horizontal surface, a lowermost edge of the flange surrounding the inlet opening is aligned with the base surface of the collection area. The funnel is thereby supported in a vertical orientation on the horizontal surface by two contact points. In this position, the residual fluid in the funnel is transferred by gravity to collect within the collection area. No residual fluid is allowed to escape from the interior of the funnel.

19 Claims, 6 Drawing Sheets

COLLECTION FUNNEL

FIELD OF THE INVENTION

The present invention relates to the field of collection of viscous fluids, whether in a kitchen or automobile environment.

BACKGROUND OF THE INVENTION

Often times, a funnel is used to transfer fluids from a container into another receptacle. This may include the transfer of automobile oil to the engine of the automobile. Alternatively, cooking fluids are often times required to be transferred from a large container into a smaller container.

The concept is the same in either environment in that a fluid is transferred into a funnel through a large opening into a small opening for communication with a downstream receptacle. When this transfer is complete, the funnel used often collects a residue of fluid between the funnel's larger intake opening and its smaller outlet opening. Unless a cloth or paper towel is used to clean the interior of the funnel, the fluid collects in the funnel and is ultimately allowed to drip from the outlet opening.

This residual fluid then must be dealt with after the fluid has been allowed to be transferred to an unintended location. In addition, if a transfer tube remains connected to the outlet opening, the free end of the tube is also allowed to transfer residual fluid along an unintended path.

SUMMARY OF THE INVENTION

It is therefore an object of the present invention to collect all residual fluid remaining in the interior of a funnel between an inlet opening and an outlet opening and also to collect residual fluid contained within a transfer tube connected to the outlet opening.

This object is obtained by a funnel having a collection area disposed at one end of the funnel. The base surface of the collection area is flat. A flange surrounding the inlet opening is positioned spaced from the collection area. When the funnel is placed in a vertical orientation with the base surface of the collection area contacting a horizontal surface, a lowermost edge of the flange surrounding the inlet opening is aligned with the base surface of the collection area. The funnel is thereby supported in a vertical orientation on the horizontal surface by two contact points. In this position, the residual fluid in the funnel is transferred by gravity to collect within the collection area. No residual fluid is allowed to escape from the interior of the funnel.

In addition, the transfer tube, if still connected to the outlet opening, is secured at its free end in a cutout portion at an upper portion of the funnel. The transfer tube is then also allowed to drain back through the outlet opening into the collection area for additional collection of residual fluid. This arrangement avoids escape of residual fluids from the funnel.

In addition, a plurality of securement tabs are positioned about the flange on the lateral side edges of the flange for securing the transfer tube in a U-shaped configuration. The free ends of the transfer tube are pointed upwardly to prevent any dripping of residual fluid from the transfer tube. A hanging opening is provided in the upper portion of the flange for hanging of the funnel on a hook or nail protruding from a vertical surface.

Accordingly, it is another object of the present invention to provide a collection funnel for collecting residual fluid contained between an inlet opening and an outlet opening so as to prevent the escape of residual fluid from the funnel.

It is yet another object of the present invention to provide a collection funnel for collecting residual fluid contained between an inlet opening and an outlet opening so as to prevent the escape of residual fluid from the funnel with the funnel including a collection area at a base portion of the funnel for collecting the residual fluid.

It is still yet another object of the present invention to provide a collection funnel for collecting residual fluid contained between an inlet opening and an outlet opening so as to prevent the escape of residual fluid from the funnel with the funnel including a collection area at a base portion of the funnel for collecting the residual fluid with the collection area defining a base surface to support the funnel in a vertical orientation when the funnel is placed upon a horizontal surface.

It is still yet another object of the present invention to provide a collection funnel for collecting residual fluid contained between an inlet opening and an outlet opening so as to prevent the escape of residual fluid from the funnel with the funnel including a collection area at a base portion of the funnel for collecting the residual fluid with the collection area defining a base surface to support the funnel in a vertical orientation when the funnel is placed upon a horizontal surface with the base surface of the collection area cooperating with a lower most surface of a flange surrounding the inlet opening to stabilize the funnel in a vertical orientation at two contact points.

These and other objects of the invention, as well as many of the intended advantages thereof, will become more readily apparent when reference is made to the following description taken in conjunction with the accompanying drawings.

BRIEF DESCRIPTION OF THE DRAWINGS

The following drawings illustrate examples of various components of the invention disclosed herein, and are for illustrative purposes only. Other embodiments that are substantially similar can use other components that have a different appearance.

DETAILED DESCRIPTION OF THE PREFERRED EMBODIMENTS

Figure 1:
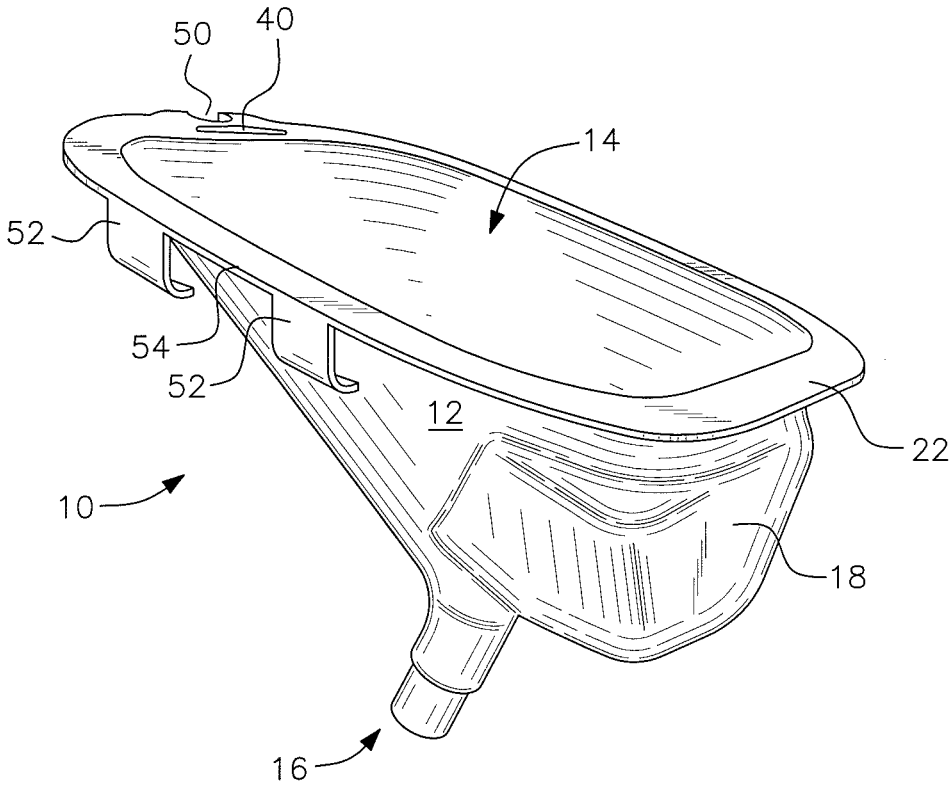
FIG. 1 is a perspective view of the collection funnel of the present invention.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

Figure 2:
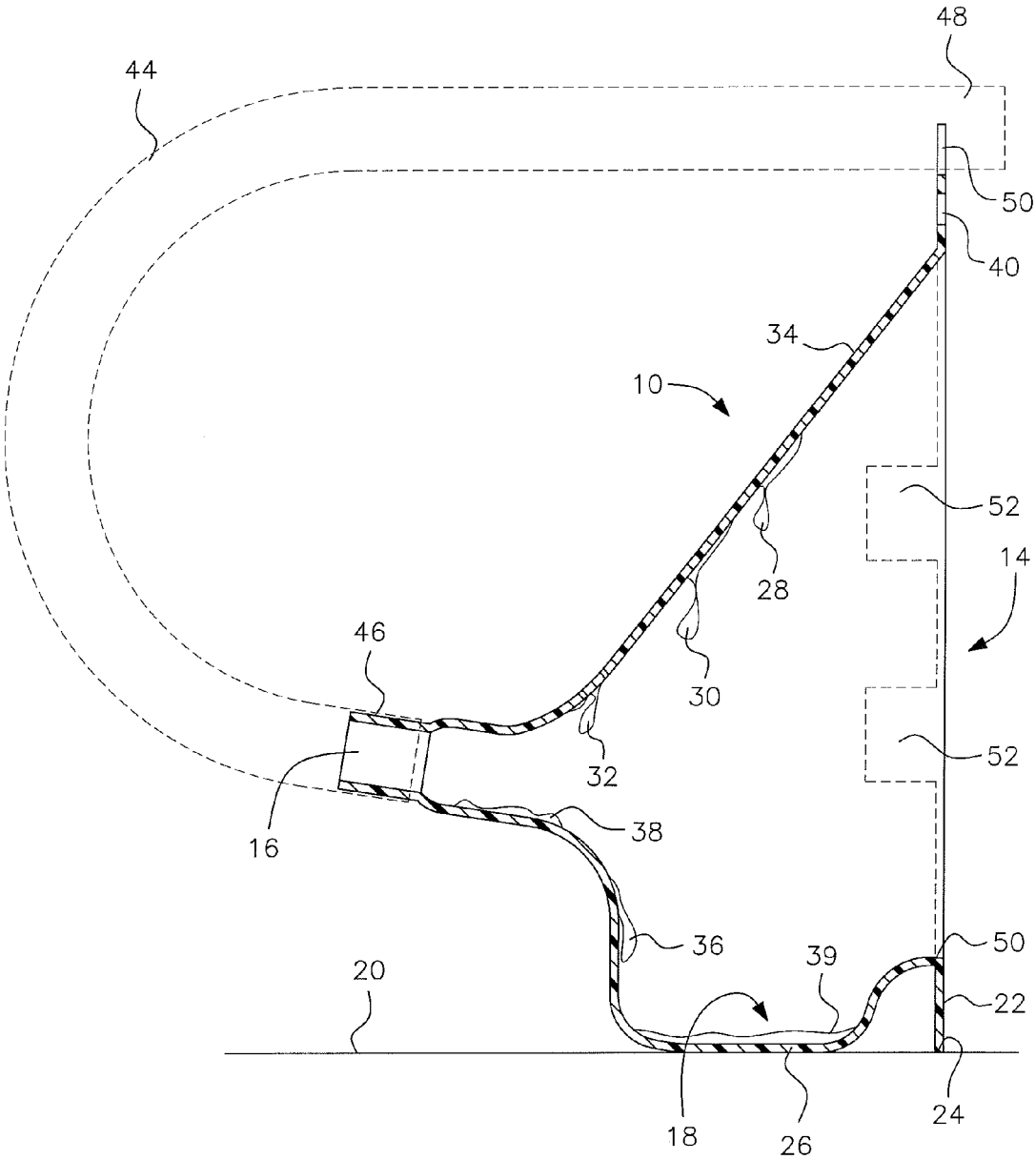
FIG. 2 is a cross-sectional view of the collection funnel illustrating the funnel positioned on a horizontal surface for collection of residual fluid in a collection area.
Figure 3:
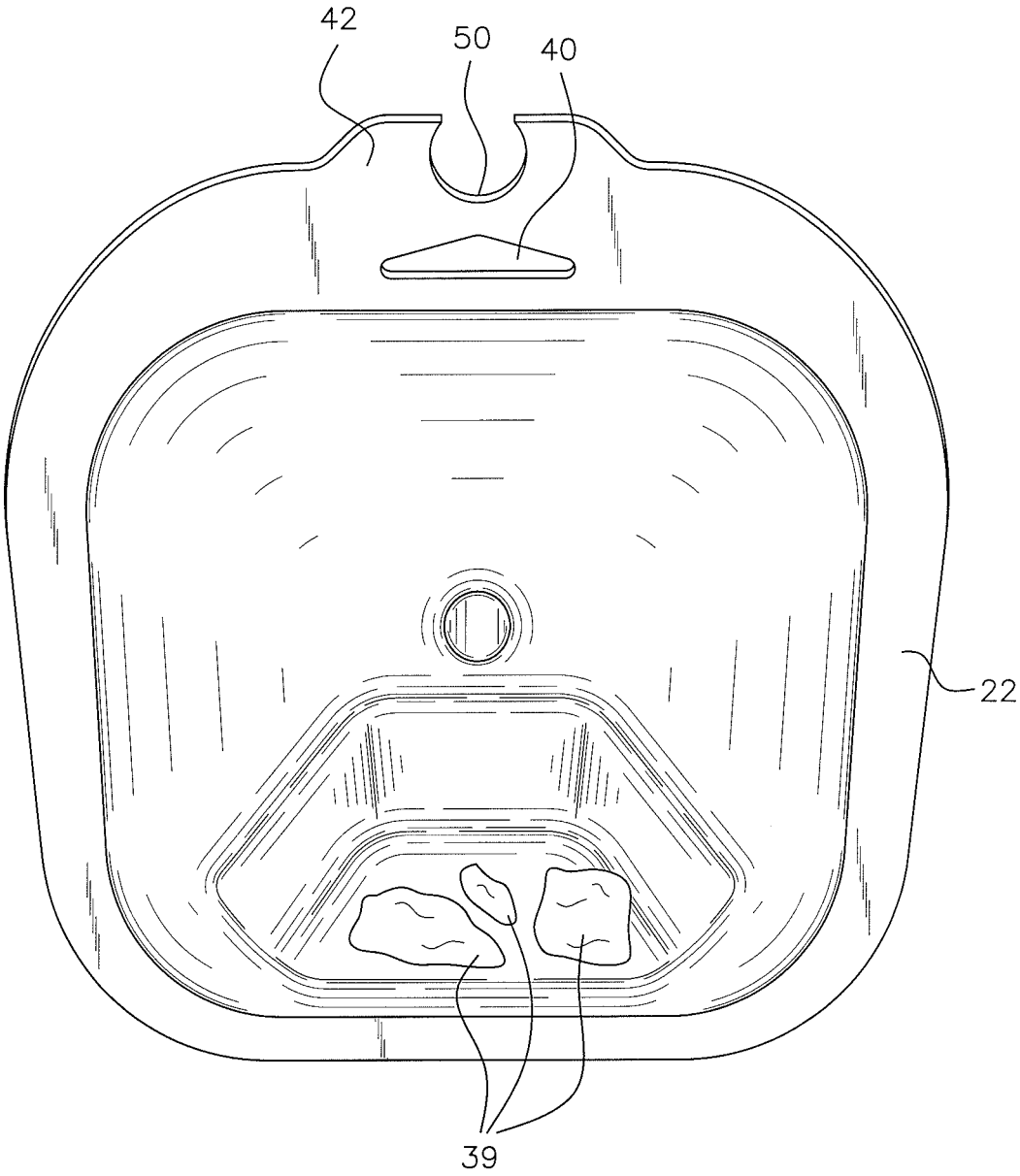
FIG. 3 is a front view of the collection funnel showing the collection of residual fluid in the collection area.
Figure 4:
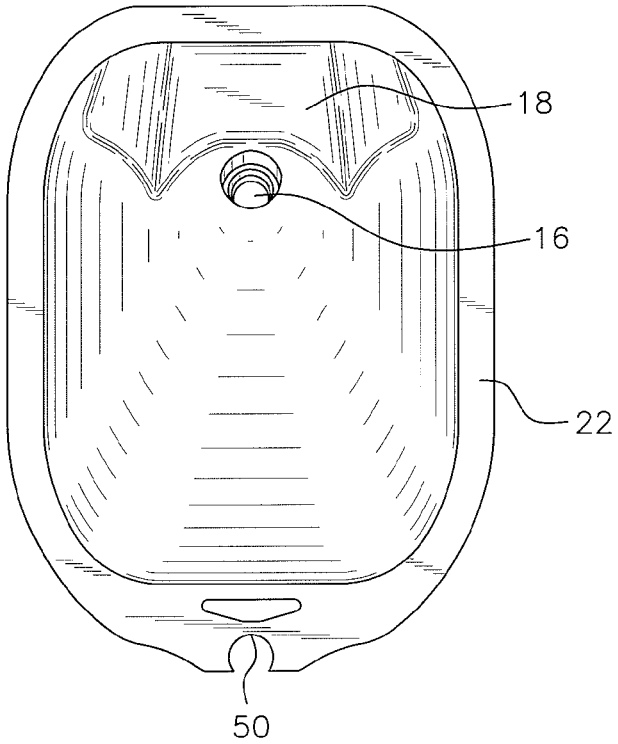
FIG. 4 is a top view of the collection funnel.

With reference to the drawings, in general, and to FIGS. 1 through 3, in particular, a collection funnel embodying the teachings of the subject invention is generally designated as 10. With reference to its orientation in FIG. 1, the collection funnel includes a body 12 having an inlet opening 14 and an outlet opening 16. Liquids are normally dispersed into the inlet opening 14 and after traveling through the body 12 of the funnel, exit the funnel through outlet opening 16.

As shown in FIG. 2, when the funnel 10 is finished being used, a collection area 18 is positioned on a horizontal surface 20 such as a counter top or working surface. Flange 22, which surrounds the inlet opening 14, includes a lower most edge portion 24 which is also moved into contact with the surface 20, so as to position the funnel in a vertical orientation. A lowermost base surface 26 of the collection area 18 also contacts the surface 20.

The collection area 18 is positioned at one end of the funnel to provide a bumped out portion of a funnel which is used to collect residual fluid in the funnel and stabilize the funnel in a vertical orientation. The depth of the collection area, below an uppermost edge of flange 22 is approximately one-half inch. The width of the collection area is approximately two inches. The sidewalls of the collection area generally follow the converging sidewalls of the remainder of the body.

As shown, residual fluid droplets 28, 30, 32 move along inclined surface 34 due to the force of gravity. In addition, residual fluid droplets 36, 38 also move along surfaces of the funnel by gravity. These droplets of residual fluid collect as residual fluid mass 39 at the bottom of collection area 18. By this mechanism, no additional steps need be taken to prevent residual fluid from leaking from the funnel located in a supported vertical orientation.

Alternatively, the funnel may be positioned along a vertical surface by passage of a nail or hook through an opening 40 in an upper portion 42 of the flange 22. In this instance, the flange, surrounding the inlet opening 14, functions to stabilize the funnel in a vertical orientation on a vertical surface against for collection of residual fluid in the collection area 18.

In addition, if a transfer tube 44 is used for transferring fluid through the outlet opening 16, the transfer tube 44 will also be a source of residual fluid. To prevent the residual fluid from leaving the transfer tube, one end 46 of the tube can be maintained in a secure position anchored on outlet opening 16. The other free end 48 of the tube may be anchored by a friction fit in circular shaped recess 50 formed in the upper portion 42 of the flange 22.

By holding the transfer tube in the position shown in FIG. 2, any residual fluids in the transfer tube will also move along the tube towards end 46 and be deposited in the collection area. The residual fluid in the funnel, as shown by residual fluid droplet 38, for example, will be deposited by subsequent movement along a slope down into the collection area 18.

As can be seen in the figures, collection area 18 has a depth of ½ to 1 inch below the inner edge 50 of flange 22. This forms a recess for collection of a significant quantity of residual fluid, if necessary.

Figure 5:
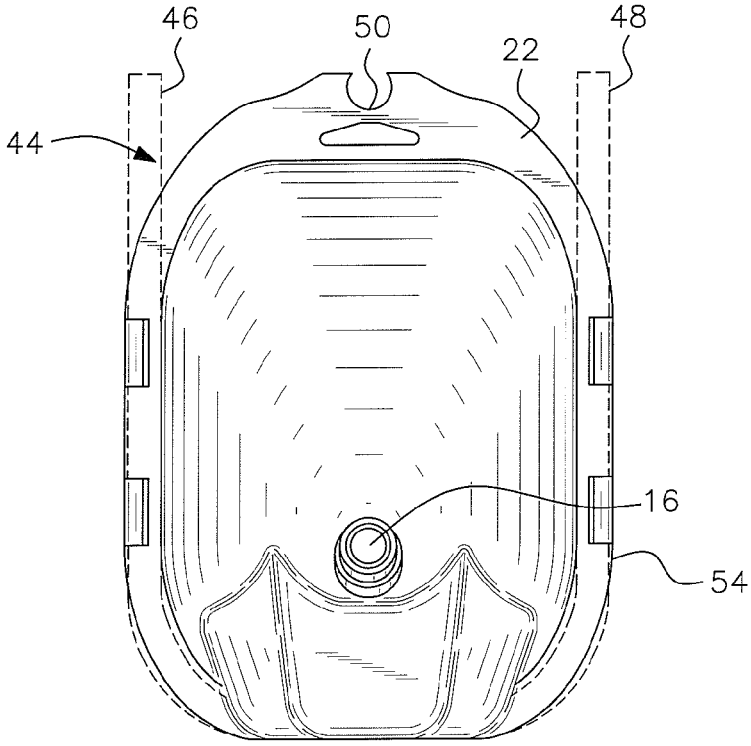
FIG. 5 is a bottom view of the collection funnel illustrating the placement of a transfer tube secured between retention tabs and the flange surrounding the inlet opening.
Figure 6:
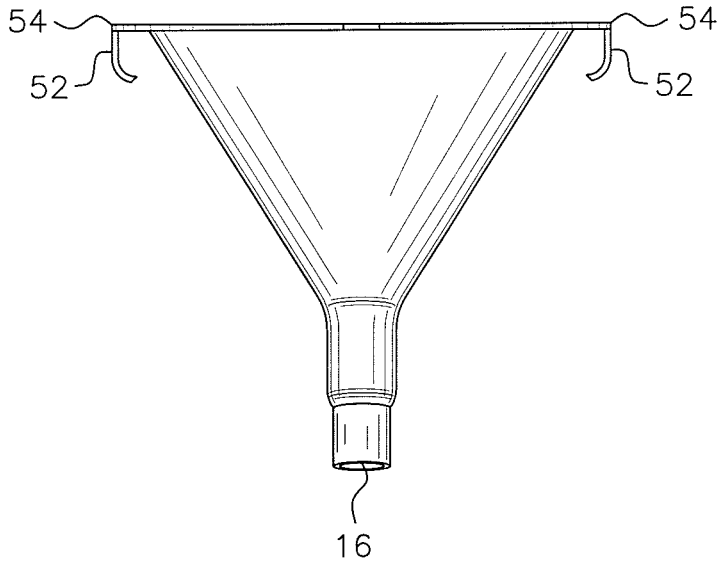
FIG. 6 is a front view of the collection funnel.
Figure 7:
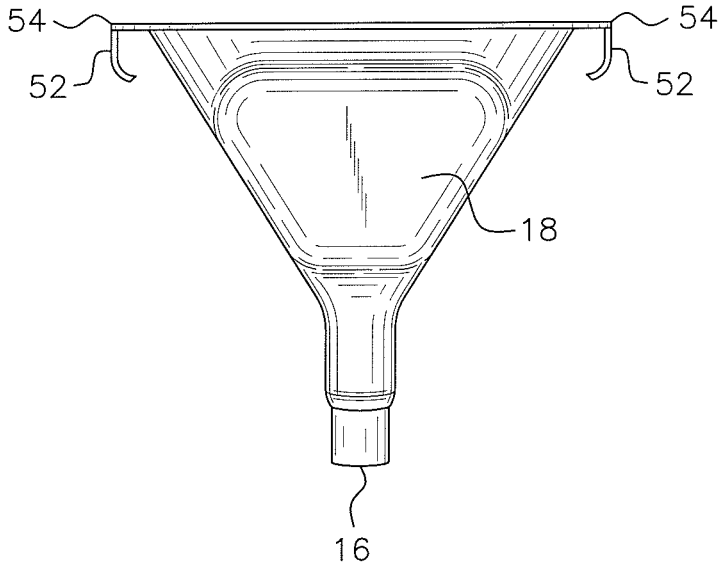
FIG. 7 is a rear view of the collection funnel.
Figure 8:
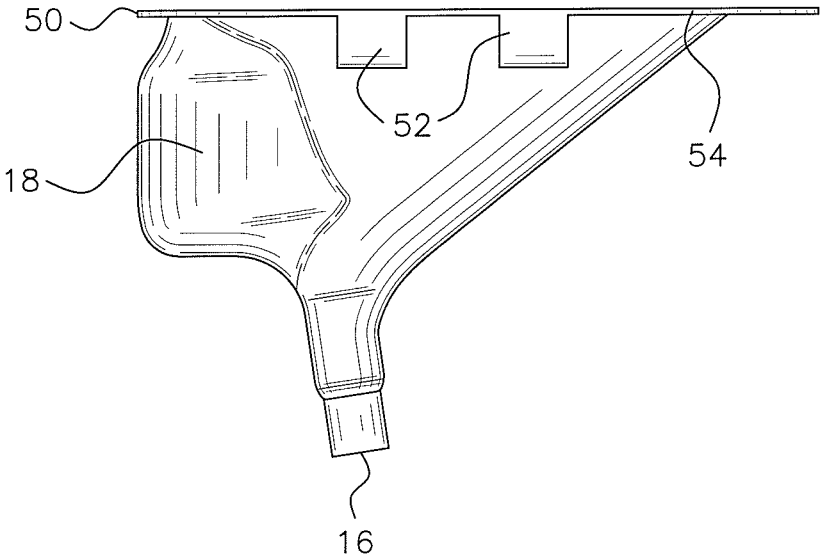
FIG. 8 is a side view of the collection funnel.

To secure the transfer tube when the transfer tube is not in use, a series of retention tabs 52 are positioned around and extend downward from an outermost edge 54 of flange 22. These tabs serve to frictionally retain the transfer tube 44 to the underside of flange 22 as shown in FIG. 5. In the U-shaped orientation of tube 44 as shown in FIG. 5, no residual fluid will be allowed to escape from free ends 46, 48.

The foregoing description should be considered as illustrative only of the principles of the invention. Since numerous modifications and changes will readily occur to those skilled in the art, it is not desired to limit the invention to the exact construction and operation shown and described, and, accordingly, all suitable modifications and equivalents may be resorted to, falling within the scope of the invention.

We claim:

1. A collection funnel comprising
- a body having an inlet opening and an outlet opening,
- a collection area for residual fluid defined between the inlet opening and the outlet opening,
- a flange extending from at least a portion of said inlet opening, and
- a base surface of said collection area, the base surface of the collection area and the flange defining an aligned two point support for the body in a vertical orientation when the body is located on a horizontal surface.

2. The collection funnel according to claim 1, wherein the base surface is flat.

3. The collection funnel according to claim 1, wherein the base surface is spaced from the flange.

4. The collection funnel according to claim 3, wherein the base surface is located spaced below an upper edge of the flange.

5. The collection funnel according to claim 4, wherein a surface of the body transitions between the upper edge of the flange and the base surface of the collection area.

6. The collection funnel according to claim 1, wherein a transfer tube is connected at one end to the outlet opening, an opposite end of the transfer tube is secured to the flange.

7. The collection funnel according to claim 6, wherein the opposite end of the transfer tube is friction fit in a circular opening defined by the flange.

8. The collection funnel according to claim 1, wherein a plurality of retention tabs extend from the flange for securing a transfer tube in a U-shape configuration.

9. The collection funnel according to claim 1, wherein the collection area is located at one end of the body, and the body tapers from the collection area towards an opposite end of the body for guiding residual fluid towards the collection area when the body is in a vertical orientation.

10. The collection funnel according to claim 9, wherein an inclined surface extends from the outlet opening towards the opposite end of the body.

11. A collection funnel comprising
- a body having an inlet opening and an outlet opening,
- a collection area for residual fluid defined between the inlet opening and the outlet opening,
- a flange extending from at least a portion of said inlet opening, and
- a base surface of said collection area, the base surface of the collection area and the flange defining an aligned two point support for the body in a vertical orientation when the body is located on a horizontal surface, said flange being spaced from the base surface and defining a gap for accommodating storage of a transfer tube.

12. The collection funnel according to claim 11, wherein the base surface is flat.

13. The collection funnel according to claim 11, wherein the base surface is located spaced below an upper edge of the flange.

14. The collection funnel according to claim 13, wherein a surface of the body transitions between the upper edge of the flange and the base surface of the collection area.

15. The collection funnel according to claim 11, wherein the transfer tube is connected at one end to the outlet opening, an opposite end of the transfer tube is secured to the flange.

16. The collection funnel according to claim 15, wherein the opposite end of the transfer tube is friction fit in a circular opening defined by the flange.

17. The collection funnel according to claim 11, wherein a plurality of retention tabs extend from the flange for securing the transfer tube in a U-shape configuration.

18. The collection funnel according to claim 11, wherein the collection area is located at one end of the body, and the body tapers from the collection area towards an opposite end of the body for guiding residual fluid towards the collection area when the body is in a vertical orientation.

19. The collection funnel according to claim 18, wherein an inclined surface extends from the outlet opening towards the opposite end of the body.

* * * * *